US006825710B2

(12) United States Patent
Moyal

(10) Patent No.: US 6,825,710 B2
(45) Date of Patent: Nov. 30, 2004

(54) CURRENT MIRROR FOR AN INTEGRATED CIRCUIT

(75) Inventor: Michael Moyal, Munich (DE)

(73) Assignee: Xignal Technologies AG, Uterhaching (DE)

( * ) Notice: Subject to any disclaimer, the term of this patent is extended or adjusted under 35 U.S.C. 154(b) by 0 days.

(21) Appl. No.: 10/421,960

(22) Filed: Apr. 24, 2003

(65) Prior Publication Data

US 2003/0222707 A1 Dec. 4, 2003

(30) Foreign Application Priority Data

Apr. 27, 2002 (DE) ..... 102 19 003

(51) Int. Cl.[7] ..... G05F 3/24; G05F 3/26
(52) U.S. Cl. ..... 327/543; 323/315
(58) Field of Search ..... 327/538, 540, 327/541, 543; 323/315, 316

(56) References Cited

U.S. PATENT DOCUMENTS 4,647,840 A 3/1987 Hiyama
5,835,994 A 11/1998 Adams
6,396,335 B1 * 5/2002 Behzad et al. ..... 327/543
6,528,981 B1 * 3/2003 Tsubaki ..... 323/315

OTHER PUBLICATIONS

Tietze/Schenk, "Halbleiter–Schaltungstechnik", Springer–Verlag, 10. Auflage, 1993, Seiten 99–101.

* cited by examiner

*Primary Examiner*—Timothy P. Callahan
*Assistant Examiner*—Terry L. Englund
(74) *Attorney, Agent, or Firm*—Rothwell, Figg, Ernst & Manbeck, P.C.

(57) ABSTRACT

An integrated circuit arrangement comprising a reference-current source device for providing a reference current (Iin) and comprising a current mirror device for mirroring the reference current (Iin) to an output current (Iout), wherein the current mirror device comprises a first FET (Q1), operated in saturation, whose channel carries the reference current; as well as a second FET (Q2), operated in saturation, whose channel carries the output current, wherein the gate connections of the two FETs (Q1, Q2) are interconnected in order to ensure identical control voltages (Vgs) at these two FETs (Q1, Q2), wherein at a channel connection of the first FET (Q1), a node for generating the reference current (Iin) carried by the channel of this FET is provided from several reference-current components (Iin1, Iin2), wherein the reference-current components are provided at the node by the reference-current source device, and one (Iin2) of the reference-current components (Iin1, Iin2) is carried by way of a resistance element (Qr) which is connected between the node and the gate connection of the first FET (Q1).

8 Claims, 2 Drawing Sheets

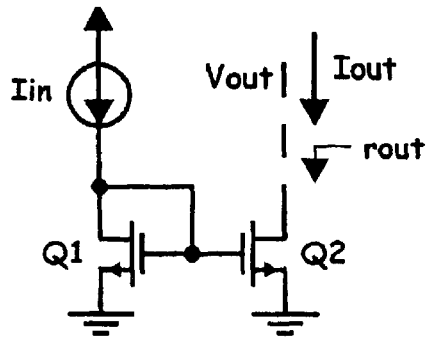
Fig.1 State of the art
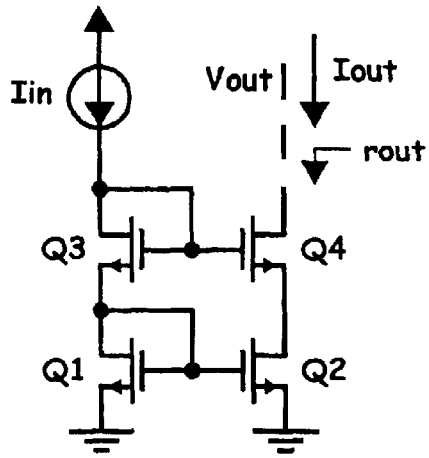
Fig.2 State of the art
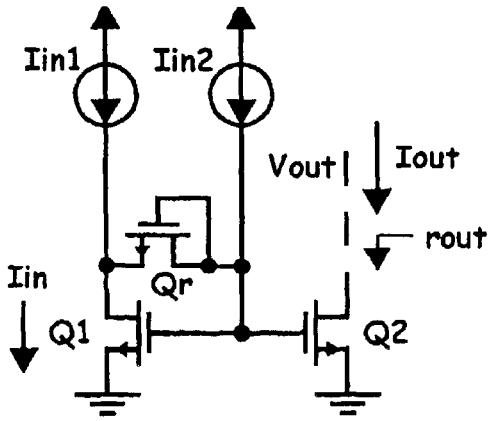
Fig.3
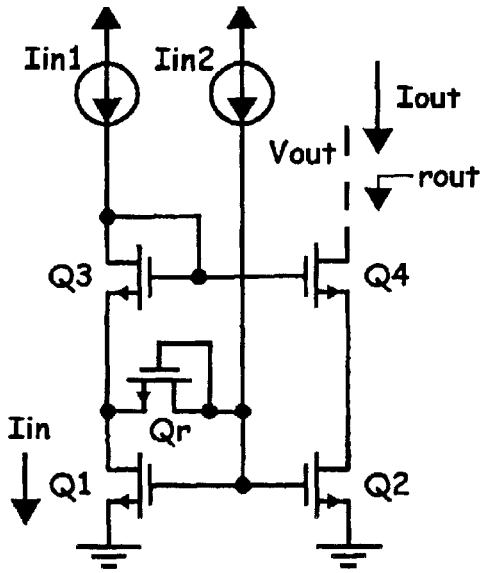
Fig.4

CURRENT MIRROR FOR AN INTEGRATED CIRCUIT

BACKGROUND TO THE INVENTION

1. Field of the Invention

The present invention relates to a current mirror device for an integrated circuit, and in particular to an integrated circuit arrangement comprising a reference-current source device for providing a reference current, and comprising a current mirror device for mirroring the reference current to an output current.

In such a circuit arrangement, a reference current provided in the region of the integrated circuit can provide the basis for a multitude of currents which are required in other regions of the integrated circuit, wherein in each instance these mirrored currents are in a predetermined ratio to the reference current.

2. Description of the State of the Art

FIG. 1 shows a known current mirror device comprising a first FET Q1, operated in saturation, whose channel carries the reference current Iin; as well as a second FET Q2, operated in saturation, whose channel carries the output current Iout; wherein the gate connections of the two FETs are interconnected in order to ensure identical control voltages (gate-source voltages) at these two FETs. Identical control voltages on the FETs result in the reference current Iin being mirrored to the output current Iout, i.e. they result in a current flowing in the channel of the FET Q2, with said current being in a fixed ratio to the reference current Iin. This ratio Iout/Iin depends on the design, in particular on the dimensions, of the FETs Q1 and Q2.

In the simplest case, for example if the FETs Q1 and Q2 are of identical design, Iout/Iin=1, or Iout=Iin applies.

In a way which is well known, such a current mirror can also mirror the reference current to a multitude of output currents, in that the gate voltage which is present at the FET Q1 due to the presence of the reference voltage Iin is not only used as a gate voltage for a second FET Q2 but as a gate voltage for a multitude of such FETs.

It is also known to bring together in one node several currents which have been generated by mirroring, as mentioned above, in order to generate an output current as the sum of these mirrored currents.

The output impedance which the load that is driven by the output current sees, is a first performance characteristic of a current mirror, which performance characteristic is important in practical application. The small-signal output impedance of the current mirror rout shown in FIG. 1 is defined as vout/iout, with vout and iout representing the small-signal sizes of the output voltage Vout and of the output current Iout. Ideally, this output impedance rout is infinite. In order to implement this approximately, it is essential that the FETs Q1 and Q2 are operated in saturation. In this operating range, as is well known, the drain current of a FET hardly deviates from the drain-source voltage.

In this context, the term "saturation" refers to an operating range in which the following relationship applies:

$$Vds > Vgs - Vth$$

wherein

Vds=drain-source voltage

Vgs=gate-source voltage (control voltage)

Vth=threshold voltage

If an effective control voltage Vgt is defined as Vgs−Vth, then the condition for saturation can also be defined as Vds>Vgt.

In the current mirror shown in FIG. 1, saturation of the FET Q1 is ensured by the connection between drain and gate of Q1 (analogous to the respective circuit in the case of bipolar transistors, Q1 is designated "diode-switched"). Consequently, due to the drain-source voltage inevitably dropping at the FET Q1, the possible range of the drain potential of Q1 is limited. Said drain-source voltage poses a problem in particular in the design of the driving current source Iin (limited "input voltage range").

The deviation available to the output current, i.e. the range of the output voltage for which range the current mirror operates at the desired current-transformation ratio, is a second important performance characteristic of a current mirror. In the current mirror shown in FIG. 1, this voltage deviation is limited in that at the channel of the FET Q2 inevitably there is a drain-source voltage drop.

FIG. 2 shows a current mirror which in the literature is often referred to as a "cascode current mirror", which has a considerably increased output impedance rout. This is achieved in that, as shown in FIG. 2, cascoded FETs are arranged in series to the FETs Q1 and Q2, with said cascoded FETs, for the reasons explained above, also having to be operated in saturation. Furthermore, for the purpose of achieving an increased output impedance, a number of modifications of the current mirror shown in FIG. 2 are known, e.g. a feedback current mirror, source degeneration current mirror, etc. These current mirrors are associated with the disadvantage that the output voltage deviation (as well as the input voltage range) is further reduced. In many cases, the option of a multiple-cascoded current mirror (e.g. double cascode current mirror) in which one or several additional cascode stages are arranged, although an imaginable and known option, is not useable in practical application due to the operating voltages of integrated circuits having continuously decreased over time.

SUMMARY OF THE INVENTION

It is the object of the present invention to improve an integrated circuit arrangement of the type described above such that for a predetermined output impedance, the output voltage deviation is increased, or for a predetermined output voltage deviation the output impedance is increased.

This object is met by an integrated circuit arrangement with a specially designed reference-current supply on the first FET. The dependent claims relate to advantageous improvements of the invention.

It is important for the invention that at a channel connection of the first FET, a node for generating the reference current carried by the channel of this FET is provided from several reference-current components, wherein the reference-current components are provided at the node by the reference-current source device, and at least one of the reference-current components is carried by way of a resistance element which is connected between the node and the gate connection of the first FET.

The reference-current component carried by way of a resistance element causes a voltage drop at this resistance element, and thus a voltage between the channel connection and the gate of the first FET, which results in an increase in the useable output voltage deviation.

A particularly simple embodiment provides for the reference-current source device, to supply two reference-current components at the node, and for one of the two reference-current components to be carried by way of the resistance element. In this arrangement, the two current components can be provided e.g. to be different from each other by a factor of max. 2, in particular to be approximately identical in size. In certain cases this can increase the accuracy of current mirroring and can simplify the design of the current source device.

Any component which causes a voltage drop as a result of a current flow through the component is suitable as a resistance element.

In a preferred embodiment the resistance element is formed by the channel of a further FET. In this way it is possible to particularly easily and reliably achieve a desired voltage drop at the resistance element within the framework of the production technology used (component matching relative to the first and second FET). To set the resistance behaviour, the gate connection of this further FET can be subjected to a predetermined voltage, preferably a voltage for which this FET is operated in saturation when the current mirror is operative. Furthermore, the gate connection can be connected to a channel connection of this FET (diode circuit).

A further particularly preferred embodiment provides for the current mirror device to comprise a third FET which is serially connected to the first FET and operated in saturation, with the channel of said third FET carrying at least one of the reference current components, and, wherein the current mirror device, serially to the second FET, comprises a fourth FET operated in saturation, with the channel of said fourth FET carrying the output current, wherein the gate connections of the third FET and of the fourth FET are interconnected in order to ensure identical control voltages at these two FETs. This application, achieved with the invention, of the voltage difference between a channel connection and the gate connection of the first FET in the case of a cascoded current mirror device is particularly advantageous because is it possible not only to achieve the considerably increased output impedance of a cascoded current mirror, but also to reduce the reduction in the output deviation which results in the state of the art from doing so. This makes it possible for example to use cascoded current mirror devices in integrated circuits whose particularly low supply voltages hitherto had made it impossible to use a cascoded current mirror.

BRIEF DESCRIPTION OF THE DRAWINGS

Below, the invention is described in more detail by means of exemplary embodiments with reference to the enclosed drawings. The following are shown:

FIG. 1 a reference-current source with a simple current mirror connected to it;

FIG. 2 a reference-current source with a cascoded current mirror connected to it;

FIG. 3 a reference-current source with a simple current mirror according to the invention connected to it;

FIG. 4 a reference-current source with a cascoded current mirror according to the invention connected to it;

DESCRIPTION OF THE PREFERRED EMBODIMENTS

Figure 5:
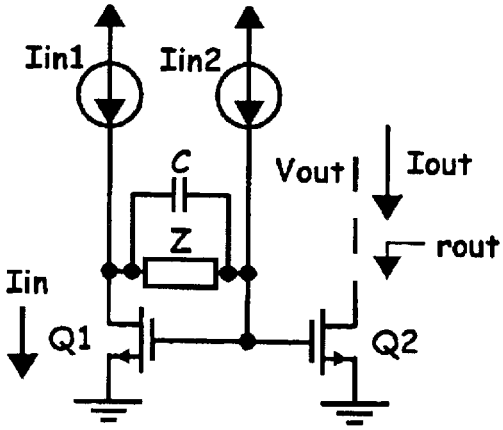
FIG. 5 a modification of the circuit shown in FIG. 3.

FIGS. 1 and 2 show the circuits which have already been described in the introduction, with a simple and a cascoded current mirror respectively.

FIG. 3 shows a reference-current source device for providing a reference current. This device comprises two current sources for providing two reference-current components Iin1 and Iin2, the sum of which represents the reference current Iin. Composing the reference current Iin takes place on a node connected to the drain of a FET Q1, so that the channel of the FET Q1 carries the reference current Iin. In this arrangement, the reference-current component Iin2 is carried by way of the channel of a further FET Qr, so that between the drain connection and the gate connection of the FET Q1, a voltage drop results due to the current flow through the FET Qr. This voltage drop reduces the drain potential relative to the gate potential of the FET Q1.

The gate connection of the FET Q1 is connected to the gate connection of a second FET Q2, in order to ensure identical control voltages at these two FETs whose source connections have the same source potential, as shown. This same source potential can be ensured by connecting the source connections with the same supply potential (as shown), or by connecting the source connections to a circuit node. As long as the two FETs Q1 and Q2 are operated in saturation, an output current Iout carried by the channel of the FET Q2 is at a fixed ratio to the reference current Iin. By suitable dimensioning of FETs Q1 and Q2, this ratio can be set to a desired value. In particular in the case of the FETs Q1 and Q2 being of the same design, "Iout=Iin1+Iin2" applies. In this case, the circuit shown mirrors the reference current Iin=Iin1+Iin2 at a ratio of 1:1 to the output current Iout. Some other mirroring ratio can be achieved by dimensioning Q1 and Q2 accordingly. Advantageously, the voltage drop at the FET Qr causes a reduced drain-source voltage at the first FET Q1, making possible a relatively large output voltage deviation at the output of the current mirror (drain of Q2).

With regard to the circuit according to FIG. 3 it has been shown to be favourable to select the current component Iin1 at least as high as the current component Iin2. Furthermore, if $\alpha$ denotes the ratio Iin1/Iin2, and $\beta$ denotes the ratio$(W/L)_{Q1}/(W/L)_{Qr}$, with W/L denoting the ratio of channel-width to channel-length of the FET designated by the index, it is advantageous if $\beta>\alpha$, in particular $\beta>10\times\alpha$ applies. The same applies analogously to the circuit described below and shown in FIG. 4. As far as the function of the circuit according to the invention is concerned, in the end it is only essential that the design of the current components and of the circuit components result in saturation of the FET Q1.

As far as the output impedance rout of this current mirror is concerned, essentially the explanations provided in the introduction in the context of the circuit according to FIG. 1 apply, i.e. the output impedance of this circuit is rather modest, and the circuit can thus be used only in applications with more modest requirements in this respect.

Analogous to the state of the art of a cascoded current mirror (as explained with reference to FIG. 2), the output impedance of the circuit shown in FIG. 3 can be improved considerably by serially arranging cascode steps or similar. Such a circuit is shown in FIG. 4.

In the circuit shown in FIG. 4, again a reference-current source device for providing a reference current Iin is provided, with said reference current Iin being formed from two reference-current components Iin1 and Iin2 and flowing through the channel of a FET Q1. The difference in relation to the embodiment according to FIG. 3 consists of the current mirror, serially to the first FET Q1 and serially to the second FET Q2, comprising a third FET Q3 and a fourth FET Q4 respectively, which together represent a cascode step for the transistor arrangement Q1, Q2 so that, advantageously, the output impedance of the current mirror (at the drain of Q4) is increased.

In the example shown in FIG. 4, the FET Q4 carries the entire output current Iout, while the FET Q3 carries only the first reference-current component Iin1. the FET Q3 is diode-switched, in order to ensure its saturation during operation. The gate connection of the FET Q3 is connected to the gate connection of the FET Q4, wherein this FET Q4 is differently dimensioned when compared to the FET Q3 such that with identical control current for the FETs Q3, Q4, the output current Iout is in the desired fixed ratio to the sum of the reference-current components Iin1 and Iin2. As already explained above, this desired ratio Iout/(Iin1+Iin2) determines the relative dimensioning of the FETs Q1, Q2 in relation to each other.

If in the circuit according to FIG. 4, Iout=a×Iin is to apply for example, wherein Iin1/Iin2=n/1, then the FETs Q1, Q2, Q3 and Q4 are to be dimensioned as follows:

$$(W/L)_{Q2}/(W/L)_{Q1}=(W/L)_{Q4}/(W/L)_{Q3}=a\times(n+1)/n,$$

wherein W/L denotes the ratio of channel width to channel length of the FET designated by the index.

Figure 6:
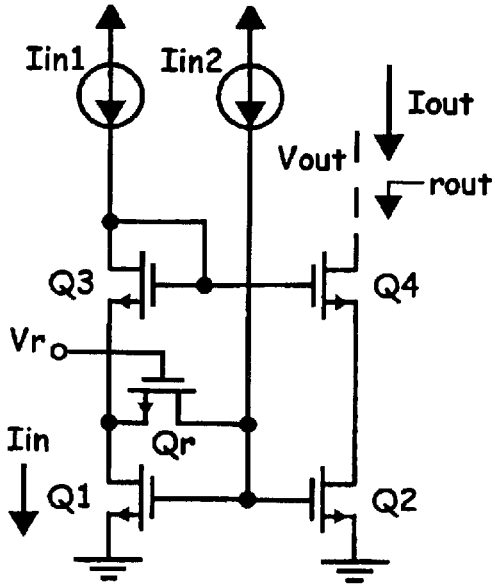
FIG. 6 a modification of the circuit shown in FIG. 4.
Figure 7:
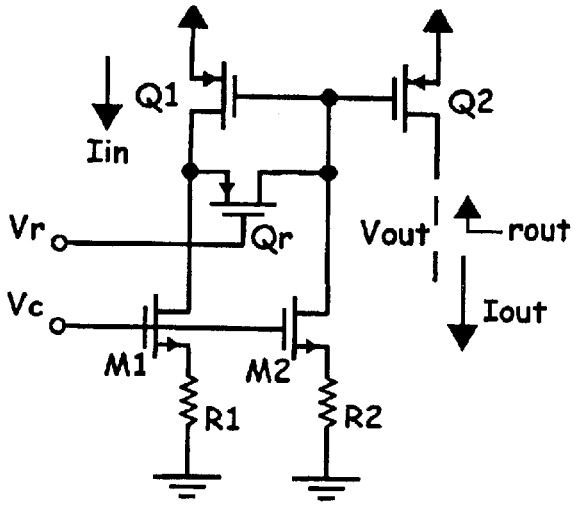
FIG. 7 a further modification of the circuit shown in FIG. 3, wherein the reference-current source is shown in greater detail.

FIGS. 5, 6 and 7 illustrate modifications of the embodiments already described above, so that below, essentially only the differences of the circuits already described above need to be discussed. For the remainder, we expressly refer to the above description.

FIG. 5 shows a modification of the circuit shown in FIG. 3. In this embodiment, generally speaking, an impedance Z with an ohmic component which differs from zero is provided as a resistance element, with a capacitor C connected in parallel to said impedance Z. This shows that the resistance element can also comprise inductive or capacitive components, which can be of advantage in some applications. Parallel connection of a capacitor as shown in FIG. 5 can for example be used to suppress any susceptibility of the circuit to oscillate. Without incorporating such a capacitor, the FET Q1 displays a tendency to oscillate due to feedback of its drain connection to its gate connection with a phase shift which is determined by the characteristics of the resistance element Z and the size of parasitic gate capacities of the FETs Q1 and Q2. By incorporating a capacitor C of suitable size, this phase shift can be changed in order to suppress oscillation.

FIG. 6 shows a modification of the circuit shown in FIG. 4. The modification consists of the further FET Qr not being diode-switched, but instead, of a predetermined voltage Vr being applied to its gate. This voltage Vr is for example a constant voltage or a regulated voltage which is based on voltages and/or currents occurring at another position of the integrated circuit. In this arrangement, unlike in the arrangements shown in FIGS. 3 and 4, it is also possible to operate the further FET Qr in the linear region.

FIG. 7 shows a modification of the circuit shown in FIG. 4. On the one hand, the modification consists of the FETs Q1, Q2 being provided as p-channel FETs whose source connections are connected to a supply potential which is positive in relation to a mass potential. On the other hand, in the circuit according to FIG. 7, the voltage Vr being applied to the gate of Qr, as already explained in the context of FIG. 6, is applied at a predetermined rate Vr.

Furthermore, the lower part of FIG. 7 shows an exemplary design of the reference-current source device. This device comprises two current sources, each of which comprises a transistor M1, M2 and an ohmic resistor R1, R2 arranged in series in relation to said transistor M1, M2. These current sources are controlled by applying a control voltage Vc to a control connection which is connected to the gate connections of both transistors M1, M2.

During operation of the current sources shown in FIG. 7, there is a voltage drop at resistors R1, R2, which voltage drop restricts the range of potentials at the drain of Q1 (and at the gate of Q1), which range is accessible to the circuit design ("restricted input voltage range"). In other words, when designing the current sources it must be taken into account that the sum of the voltage-drops at the current mirror transistors Q1, Q2, at the current source resistors R1, R2 and at the current source transistors M1, M2 cannot exceed the supply voltage of this circuit block. The reduction in the voltage drop at the current mirror transistors Q1, Q2, which reduction becomes possible with the invention, thus advantageously reduces the requirements in the design of the current sources. Thus, the invention provides particular advantages when current sources of the type shown in FIG. 7 are used.

In summary, the embodiments described make it possible to design an integrated circuit arrangement comprising a reference-current source device for providing a reference current (Iin) and comprising a current mirror device for mirroring the reference current (Iin) to an output current (Iout), wherein the current mirror device comprises a first FET (Q1), operated in saturation, whose channel carries the reference current; as well as a second FET (Q2), operated in saturation, whose channel carries the output current, wherein the gate connections of the two FETs (Q1, Q2) are interconnected in order to ensure identical control voltages (Vgs) at these two FETs (Q1, Q2), wherein at a channel connection of the first FET (Q1), a node for generating the reference current (Iin) carried by the channel of this FET is provided from several reference-current components (Iin1, Iin2), wherein the reference-current components are provided at the node by the reference-current source device, and at least one (Iin2) of the reference-current components (Iin1, Iin2) is carried by way of a resistance element (Qr) which is connected between the node and the gate connection of the first FET (Q1).

What is claimed is:

1. An integrated circuit arrangement comprising a reference-current source device for providing a reference current (lin) and comprising a current mirror device for mirroring the reference current (lin) to an output current (lout), wherein the current mirror device comprises a first FET (Q1), operated in saturation, whose channel carries the reference current; as well as a second FET (Q2), operated in saturation, whose channel carries the output current, wherein the gate connections of the two FETs (Q1, Q2) are interconnected in order to ensure identical control voltages (Vgs) at these two FETs (Q1, Q2), wherein at a channel connection of the first FET (Q1), a node for composing the reference current (lin) carried by the channel of this FET from several reference-current components (lin1 lin2) is provided, wherein the reference-current components are provided at the node by the reference-current source device, and one (lin2) of the reference-current components (lin1, lin2) is carried by way of a resistance element (Qr) which is connected between the node and the gate connection of the first FET (Q1), and wherein the current value of a first reference component of said several reference-current components is at least equal to the current value but not more than twice the current value of a second reference component of said several reference-current components.

2. The circuit arrangement according to claim 1, wherein the reference-current source device provides two reference-current components (lin1, lin2) at the node.

3. The circuit arrangement according to claim 1, wherein the resistance element (Qr) is formed by the channel of a further FET.

4. The circuit arrangement according to claim 3, wherein a predetermined voltage (Vr) is applied to the gate connection of the further FET.

5. The circuit arrangement according to claim 3, wherein the gate connection of the further FET is connected to a channel connection of this further FET.

6. The circuit arrangement according to claim 1, wherein the current mirror device further comprises a third FET (Q3) which is serially connected to the first FET (Q1) and operated in saturation, with the channel of said third FET (Q3) carrying at least one (lin1) of the reference-current components (lin1, lin2), and, wherein the current mirror device, serially to the second FET (Q2), further comprises a fourth FET (Q4) operated in saturation, with the channel of said fourth FET (Q4) carrying the output current (lout), wherein the gate connections of the third FET (Q3) and of the fourth FET (Q4) are interconnected in order to ensure identical control voltages (Vgs) at these two FETs (Q3, Q4).

7. The circuit arrangement according to claim 1, wherein the current value of a first reference component of said several reference-current components is approximately a same value as the current value of a second reference component of said several reference-current components.

8. The circuit arrangement according to claim 2, wherein the current value of a first reference component of said two reference-current components is approximately a same value as the current value of a second reference component of said two reference-current components.

* * * * *